US007380922B2

(12) United States Patent
Sakurai

(10) Patent No.: US 7,380,922 B2
(45) Date of Patent: Jun. 3, 2008

(54) INKJET PRINTER HEAD HAVING ARRANGEMENT FOR EVEN DISTRIBUTION OF INK INTO INK INLETS

(75) Inventor: Hisaki Sakurai, Aichi-ken (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 337 days.

(21) Appl. No.: 11/223,160

(22) Filed: Sep. 8, 2005

(65) Prior Publication Data

US 2006/0050113 A1 Mar. 9, 2006

(30) Foreign Application Priority Data

Sep. 8, 2004 (JP) ..... 2004-260605

(51) Int. Cl.
*B41J 2/17* (2006.01)
*B41J 2/175* (2006.01)

(52) U.S. Cl. ..... 347/84; 347/85

(58) Field of Classification Search ..... 347/30, 347/84, 85, 86

See application file for complete search history.

(56) References Cited

U.S. PATENT DOCUMENTS 6,193,356 B1 * 2/2001 Takata ..... 347/30
2005/0206696 A1 * 9/2005 Inoue ..... 347/85

FOREIGN PATENT DOCUMENTS

JP 2003-220705 8/2003

* cited by examiner

*Primary Examiner*—Stephen D. Meier
*Assistant Examiner*—Carlos A Martinez, Jr.
(74) *Attorney, Agent, or Firm*—Reed Smith LLP

(57) ABSTRACT

An inkjet printer head includes: (a) a head unit having a plurality of ink inlets and operable to eject an ink which is supplied through the ink inlets from an ink source, for performing a recording operation; (b) an ink channel held in communication with the ink source; (c) a plurality of branch channels held in communication with the ink inlets; and (d) a rollable body movably disposed at a fork at which the ink channel is divided into the branch channels.

16 Claims, 7 Drawing Sheets

INKJET PRINTER HEAD HAVING ARRANGEMENT FOR EVEN DISTRIBUTION OF INK INTO INK INLETS

This application is based on Japanese Patent Application No. 2004-260605 filed in Sep. 8, 2004, the content of which is incorporated hereinto by reference.

BACKGROUND OF THE INVENTION

1. Field of the Invention

The present invention relates to an inkjet printer head.

2. Discussion of Related Art

There is known an inkjet printer head including: a head unit having an ink inlet, a multiplicity of pressure chambers and a multiplicity of nozzles; an ink supply passage communicating an ink source and the ink inlet so as to supply an ink from the ink source to the ink inlet; and a piezoelectric actuator plate mounted on the head unit and operable to pressurize the ink stored in a selected one or ones of the pressure chambers so that the ink is ejected through a corresponding one or ones of the nozzles which are held in communication with the selected pressure chamber or chambers.

To the ink inlet of the head unit, there is connected a resin member defining an ink channel which is held in communication with the ink supply passage, so that the ink can be supplied into the head unit from the ink source via the ink channel defined by the resin member. There is an arrangement in which a plurality of ink inlets are provided in the head unit, for distributing the ink into a plurality of portions of a nozzle plate which is provided by a lower portion of the head unit, so that the ink can be ejected evenly from the multiplicity of nozzles which are formed through the nozzle plate. In this arrangement, a plurality of branch channels are interposed between the single ink channel and the plurality of ink inlets, so that the ink is supplied from the ink source to each of the plurality of ink inlets via the single ink channel and a corresponding one of the branch channels.

It is common that the single ink channel communicated with the ink source via the ink supply passage is forked or divided into two branch channels as the plurality of branch channels.

JP-2003-220705A discloses an inkjet printer head unit in which an ink channel is divided into two branch channels at a fork that is surrounded by a circumferential wall. The circumferential wall is tapered such that a diameter defined by the circumferential wall is increased as viewed in a direction of flow of an ink supplied from an ink source (see FIG. 11 of JP-2003-220705A), for restraining an air from being accumulated in the fork or the branch channels.

In the arrangement in which the ink channel communicated with the ink source via the ink supply passage is simply divided into the two branch channels, the ink could flow into only one of the two branch channels, rather than into both of the two branch channels. In such an event, however, this state is maintained without the ink being forced to flow into the other branch channel, so that the ink cannot be distributed evenly into the two branch channels.

The provision of the tapered circumferential wall surrounding the fork is effective merely to provide a large ink passage so as to stabilize the flow of the ink therethrough, but does not serve to recover even distribution of the ink into the two branch channels.

SUMMARY OF THE INVENTION

The present invention was made in view of the background prior art discussed above. It is therefore an object of the invention to provide an inkjet printer head having an arrangement making it possible to distribute an ink evenly into a plurality of ink inlets of a head unit which is equipped with a nozzle plate, when the ink is supplied to the head unit from an ink source which is held in communication with the ink inlets via an ink channel and a plurality of branch channels. This object may be achieved according to a principle of the present invention, which provides an inkjet printer head including: (a) a head unit having a plurality of ink inlets and operable to eject an ink which is supplied through the ink inlets from an ink source, for performing a recording operation; (b) an ink channel held in communication with the ink source; (c) a plurality of branch channels held in communication with the ink inlets; and (d) a rollable body movably disposed at a division or fork at which the ink channel is divided into the branch channels.

In the present inkjet printer head in which the rollable body is movably disposed at the fork, a resistance against flow of the ink into each of the branch channels is changed by movement of the rollable body based on the flow of the ink, so that the ink is forced to flow evenly into the branch channels.

In the inkjet printer head, the rollable body is preferably configured to be rolled toward one of the branch channels in which static pressure is lowered by the ink flowing around the rollable body. That is, the rollable body can be rolled toward the above-described one of the branch channels into which the ink currently flows, so that an entrance of that one branch channel is narrowed while an entrance of the other branch channel or channel (into which the ink does not currently flows) is widened, whereby even distribution of the ink into the plurality of branch channels is recovered.

BRIEF DESCRIPTION OF THE DRAWINGS

The above and other objects, features, advantages and technical and industrial significance of the present invention will be better understood by reading the following detailed description of presently preferred embodiments of the invention, when considered in connection with the accompanying drawings, in which.

DETAILED DESCRIPTION OF THE PREFERRED EMBODIMENTS

Figure 1:
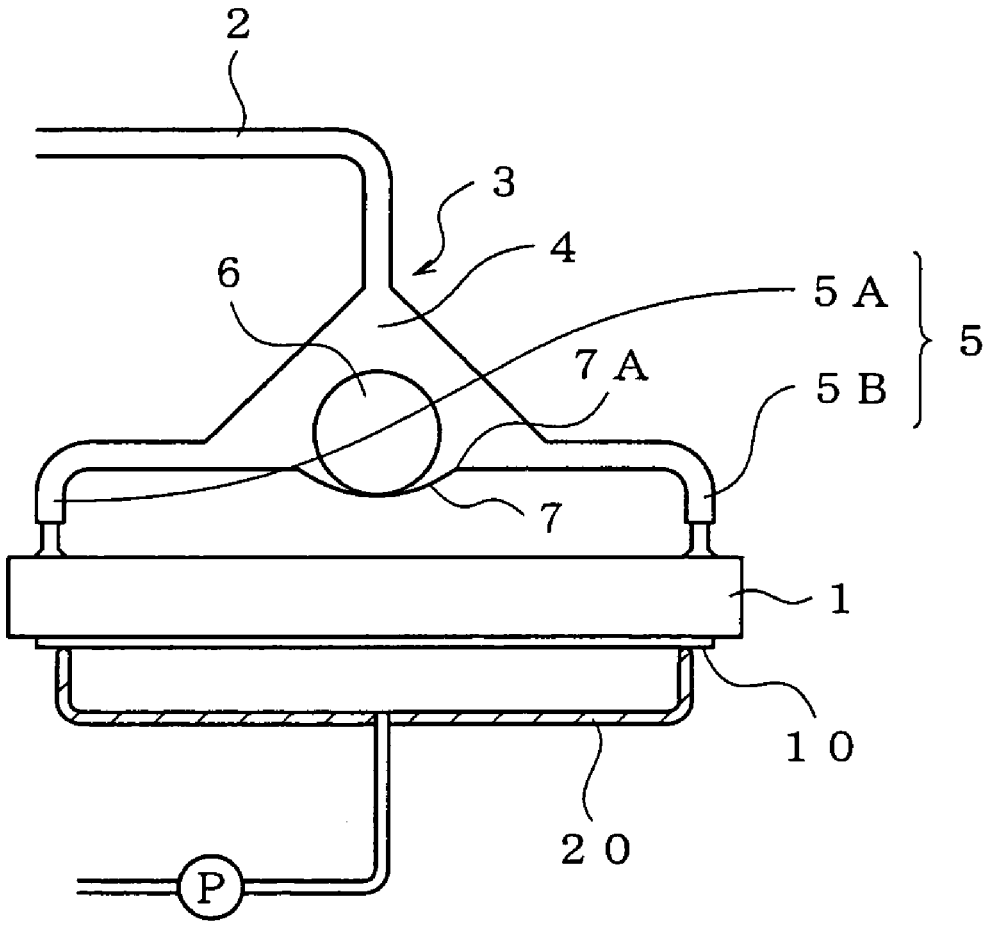
FIG. 1 is a view schematically illustrating an arrangement in which an ink storage chamber is provided at a fork at which an ink channel is divided into two branch channels.

Referring to the drawings, there will be described embodiments constructed according to the invention.

Figure 4A:
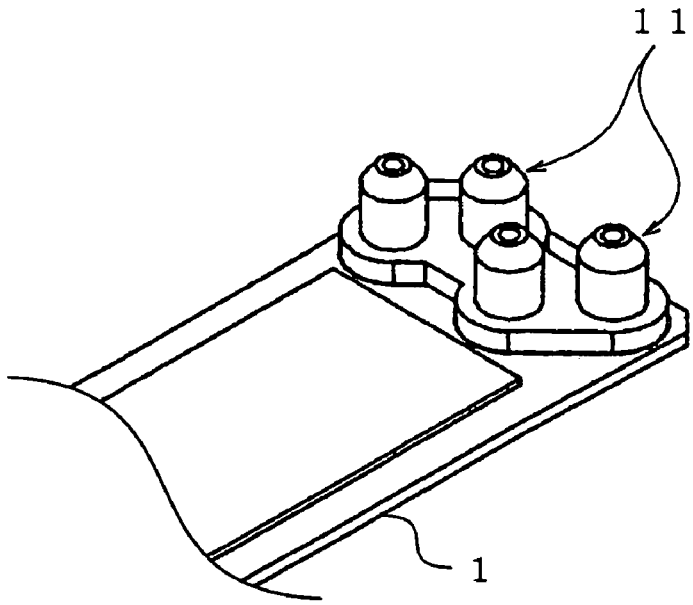
FIG. 4A is a perspective view showing passage defining members provided on a head unit.
Figure 5:
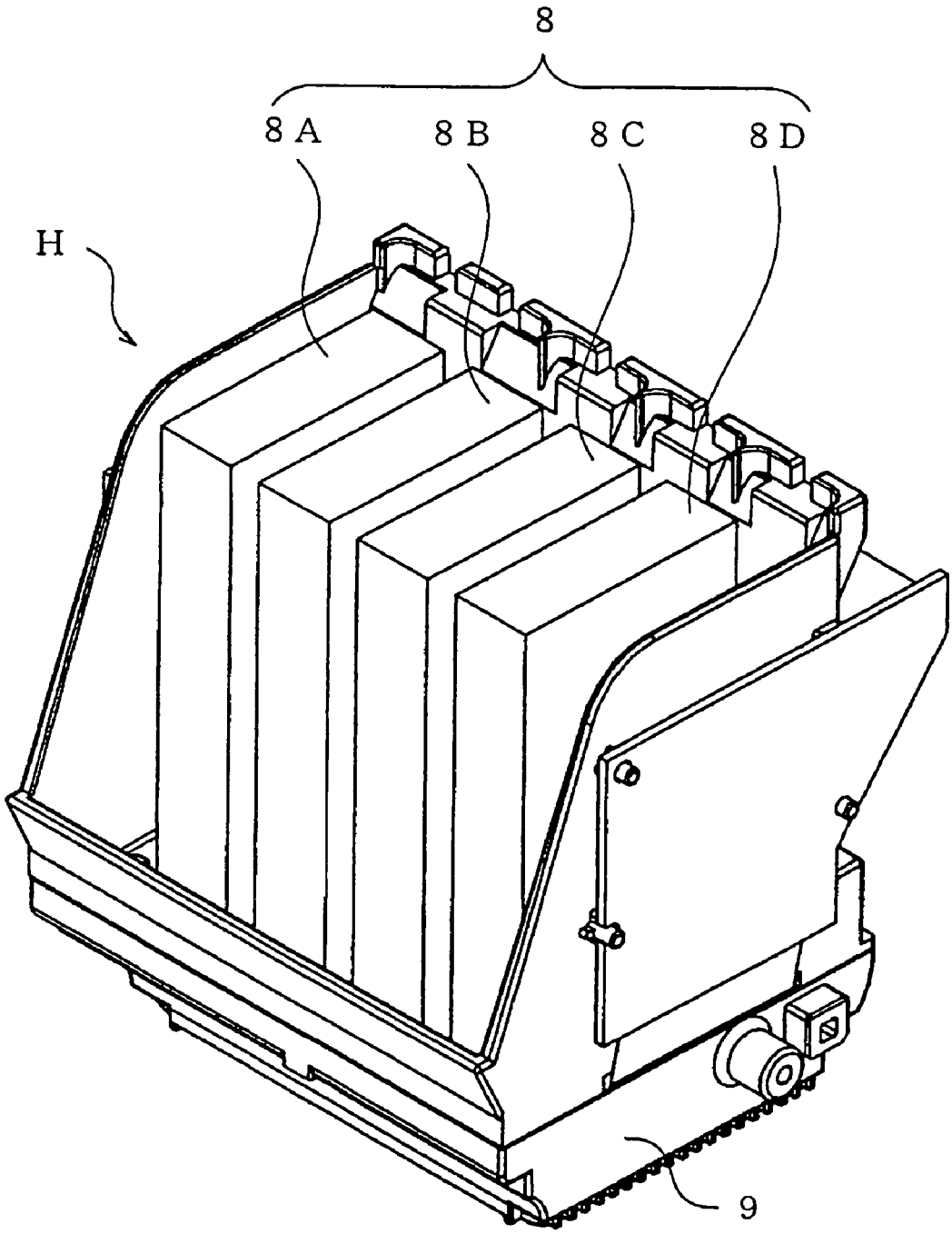
FIG. 5 is a perspective view showing an inkjet printer head on which ink cartridges are mounted.

FIG. 5 shows an example of an inkjet head printer head H. This inkjet head printer head H is a component of an inkjet printer arranged to perform a printing operation onto a recoding medium which is fed in a feed direction, for example, by scanning in a direction perpendicular to the feed direction. As shown in FIG. 5, the inkjet printer head H, which is mounted on a carriage that is to be reciprocated in the direction perpendicular to the feed direction, is principally constituted by a plurality of ink cartridges 8 (8A, 8B, 8C, 8D) storing respective different color inks, a cartridge holder 9 on which the ink cartridges 8 are detachably mounted, and a plurality of head units 1 disposed on a lower surface of a bottom portion of the cartridge holder 9. Each of the head units 1 has a plurality of ink inlets and operable to eject the inks (which are supplied through the ink inlets from the ink cartridges 8 as an ink source,) through a multiplicity of nozzles formed through a nozzle plate, for performing the printing operation. In each of the ink inlets of the head unit 1, a passage defining member 11 (see FIG. 4A) equipped with a filter is provided to prevent dusts or other foreign matters from flowing into the head unit 1 through the ink inlet. It is noted that the head units 1 are positioned in positions which are invisible in FIG. 5.

The inkjet printer head H further includes a joint member connecting an ink outlet of each of the ink cartridges 8 and a corresponding one of the head units 1. Each of the head units 1 is provide by a laminar structure including a plurality of mutually superposed plates such as the above-described nozzle plate and an actuator plate. Since each of the head units 1 has the same construction as a known head unit of an inkjet printer, redundant description of its construction is not provided. Each of the head units 1, disposed on the lower surface of the bottom portion of the cartridge holder 9, is provided with the passage defining members 11 (see FIG. 4A) which are arranged to extend through the bottom portion of the cartridge holder 9 so as to be connected to the respective joint members, so that the inks can be supplied to the nozzle plate from the ink cartridges 8 via the joint members and the passage defining members 11.

In the present embodiment, the plurality of ink inlets are provided in each of opposite end portions of the head unit 1, for distributing the inks into a plurality of portions of the nozzle plate which is provided by a lower portion of the head unit 1, so that the inks can be ejected evenly from the multiplicity of nozzles which are formed through the nozzle plate. In this arrangement, a plurality of branch channels are interposed between a single ink channel (connected to an ink supply passage communicated with the ink source) and the plurality of ink inlets, so that the corresponding ink is supplied from the ink source to the plurality of ink inlets via the single ink channel and the branch channels.

Figure 4B:
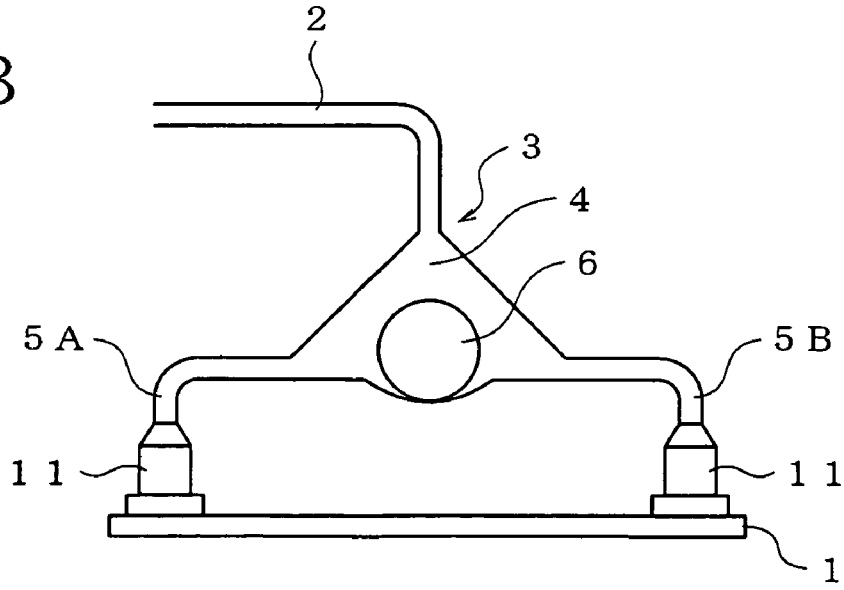
FIG. 4B is a view schematically illustrating connections of the two branch channels with the respective passage defining members.

FIG. 4A shows an example of the head unit 1 in which four passage defining members 11 are provided in each of its opposite end portions. FIG. 4B schematically shows an arrangement for distributing the ink into the passage defining members 11 provided in the opposite end portions of the head unit 1.

Described specifically, the two branch channels 5A, 5B are connected to the joint member defining the single ink channel 2, and also to the passage defining members 11 provided in the opposite end portions of the head unit 1. In other words, the ink channel 1, through which a corresponding one of the inks flows, is divided at a division or fork 5, into the branch channels 5A, 5B. Thus, the ink is distributed into the opposite end portions of the head unit 1. That is, in the present embodiment, the head unit 1 has a plurality of ink inlets through which each one of the inks is to be supplied into the head unit 1 therethrough.

In general, a usual printing operation is carried out at an ink consumption rate at which the ink as whole is made to flow moderately, so that the ink can be supplied into the head unit 1 (in which the ink is distributed into the nozzles), neither too much nor too little. On the other hand, when the ink is initially introduced into the head unit 1 or when the ink cartridge is replaced with a new one, the head unit 1 is subjected to a purging operation, since air bubbles which might have entered ink passages of the head unit 1 have to be discharged from the head unit 1. In the purging operation, the ink is caused to flow strongly, so that the air bubbles remaining in the ink passages are discharged together with the ink. However, where there is a difference between the ink passages with respect to resistance against the ink flow, the ink tends to flow through one of the ink passages in which the resistance is lower than in the other ink passages, even if the difference is small.

There will be described an arrangement for rapidly distributing the ink into the plurality of ink inlets, referring to FIGS. 1-3.

In the present embodiment, as shown in FIG. 1, an arrangement in which an ink storage chamber 4 is provided at the fork 3 at which the single ink channel 2 is divided into the two branch channels 5A, 5B. The ink storage chamber 4 is defined by an upper wall, a conical-shaped circumferential wall 4A and a bottom wall. The ink channel 2 is connected to the ink storage chamber 4 through an opening which is formed through the upper wall, while the two branch channels 5A, 5B are connected to the chamber 4 through respective openings each of which is formed through a lower portion of the circumferential wall 4A.

FIG. 1 shows a state in which a cap member 20 connected to a suction pump is held in contact with the nozzle plate 10 provided by the lower portion of the head unit 1, for carrying out the purging operation.

In the ink storage chamber 4, there is accommodated a rollable body 6. That is, the ink storage chamber serves as an accommodation chamber for accommodating the rollable body 6 therein, in addition to serving for temporarily store the ink therein. An outer surface of the rollable body 6 and an inner surface of the conical-shaped circumferential wall 4A cooperate with each other to define therebetween a restrictor passage for restricting flow of the ink from the ink channel 2 toward each of the branch channels 5A, 5B. For enabling the rollable body 6 to be freely movable, in the present embodiment, the rollable body 6 is provided by a spherical body, and is disposed on a recess 7 formed in the bottom wall defining the storage chamber 4. The recess 7 has a part-spherical surface as a curved surface (downwardly convexed surface) whose radius of curvature is tuned to facilitate free movement of the rollable body 6. In the present embodiment, the radius of curvature of the curved surface of the recess 7 is larger than a radius of the rollable body 6.

Since the rollable body 6 is arranged to be freely movable on the recess 7, the rollable body 6 can be easily moved based on change in static pressure caused by the ink flowing through the storage chamber 4. The movement of the rollable body 6 will be described in detail, by reference to FIGS. 2A-2C.

Figure 2A:
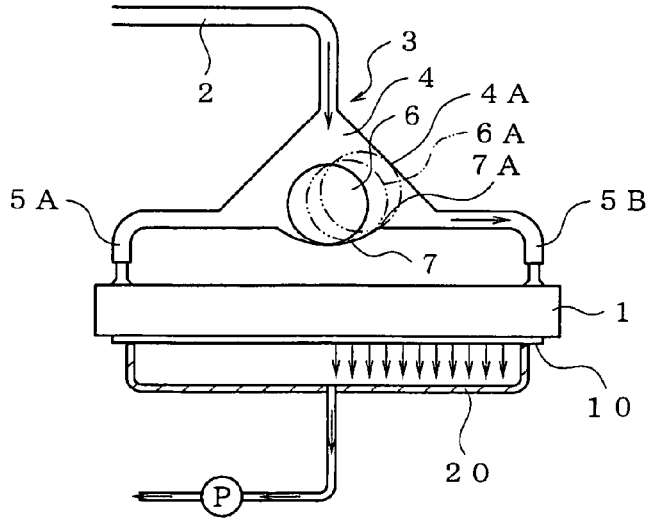
FIG. 2A is a view showing movement of a rollable body disposed in the ink storage chamber, in a state where an ink flows into a right one, as seen in this figure, of the two branch channels.

FIG. 2A shows a state where most of the ink, which has been supplied from a corresponding one of the ink cartridges 8 (ink source) via the ink channel 2, flows into a right one 5B, as seen in FIG. 2A, of the two branch channels 5, from the ink storage chamber 4. This state could be induced due to difference between the two branch channels 5A, 5B with respect to resistance against the ink flow, as a result of an increase in the resistance against the ink flow through a left one 5A of the two branch channels 5, which increase is caused, for example, when the air bubbles problematically remain in the left branch channel 5A.

The ink storage chamber 4 provides a space where there is provided the fork 3 at which the ink channel 2 is divided into the two branch channels 5A, 5B, and where the ink is temporarily stored. The space is defined at its lower end by the bottom wall having the recess 7 formed in its central portion. The rollable body 6 is disposed on the curved surface of the recess 7.

In the present embodiment, as described above, the rollable body 6 is provided by the spherical body, while the radius of curvature of the curved surface of the recess 7 is tuned to enable the rollable body 6 to be easily moved. Thus, the rollable body 6 is arranged to be freely movable in all directions over 360° around the body 6.

Further, the weight and size of the rollable body 6 provided by the spherical body are respective values which facilitate the rollable body 6 to be moved owing to a difference between the branch channels 5A, 5B with respect to static pressure therein, which difference is caused by the ink flowing around the rollable body 6.

In the state shown in FIG. 2A, in which a larger amount of the ink flows into the right branch channel 5B than into the left branch channel 5A, the rollable body 6 having the weight and size of the above-described respective values is drawn toward the right branch channel 5B in which the static pressure is reduced by the flow of the larger amount of the ink. That is, the rollable body 6 is moved from its home position (center position) indicated by solid line to a position indicated by one-dot chain line, as shown in FIG. 2A. This movement of the rollable body 6 reduces a cross sectional area of the restrictor passage for allowing the flow of the ink into the right branch channel 5B in a restricted manner, thereby increasing the resistance against the flow of the ink into the right branch channel 5B, and increases a cross sectional area of the restrictor passage for allowing the flow of the ink into the left branch channel 5A in a restricted manner, thereby facilitating the flow of the ink into the left branch channel 5A.

For avoiding separation of the rollable body 6 (which is movable disposed on the curved surface of the recess 7) from the curved surface of the recess 7, namely, for maintaining contact of the rollable body 6 with the curved surface of the recess 7, the rollable body 6 has the size that inhibits the body 6 from passing over a periphery 7A of the recess 7 when the body 6 is brought into contact with an inner surface of the conical-shaped circumferential wall 4A of the ink storage chamber 4. That is, the rollable body 6 is given the size causes the body 6 to be held in contact with at least a portion of the curved surface of the recess 7, even where the body 6 is brought into contact with a portion of the inner surface of the circumferential wall 4A. In the present embodiment, the circumferential wall 4A provides a movement limiter serves to limit the movement of the rollable body 6 such that the body 6 is movable within a limited area in which the body 6 is in contact with the curved surface of the recess 7.

As described above, when the larger amount of the ink flows into the right branch channel 5B, the rollable body 6 is drawn toward the right branch channel 5B, thereby reducing an area through which the ink is allowed to flow into the right branch channel 5B, and accordingly increasing the resistance acting on the flow of the ink toward the right branch channel 5B. Therefore, for the ink newly supplied into the ink storage chamber 4, it becomes difficult to flow into the right branch channel 5B. Thus, the newly supplied ink is forced to flow into the branch channel other than the branch channel 5B.

That is, owing to the presence of the rollable body 6 which is freely movable within the ink storage chamber 4, it is possible to generate a force serving to substantially equalize amounts of flows of the ink through the respective branch channels 5, namely, to distribute the ink evenly to the branch channels 5.

Figure 2B:
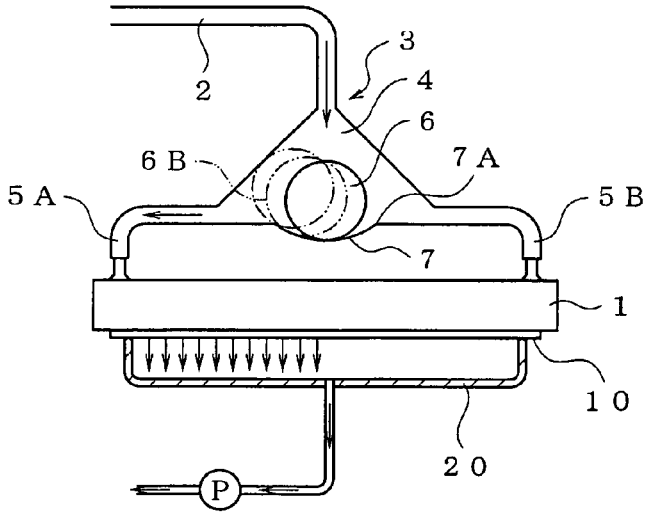
FIG. 2B is a view showing movement of the rollable body in a state where the ink flows into a left one of the two branch channels.

On the other hand, in the state shown in FIG. 2B, in which a larger amount of the ink flows into the left branch channel 5A than into the right branch channel 5B, the rollable body 6 is drawn toward the left branch channel 5A, thereby increasing the resistance acting on the flow of the ink toward the left branch channel 5A.

Figure 2C:
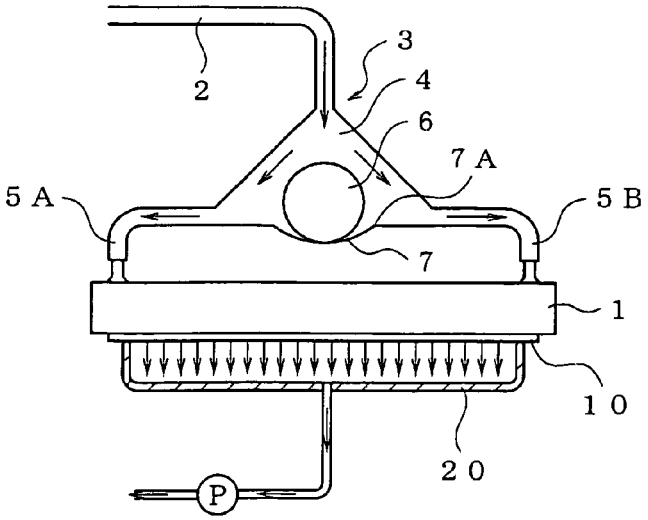
FIG. 2C is a view showing movement of the rollable body in a state where the ink flows evenly into the two branch channels.

That is, as a result of the movement of the rollable body 6 which is disposed to be freely movable within the recess 7, the flow resistance in the left branch channel 5A, into which the larger amount of the ink currently flows, is increased, whereby the newly supplied ink is forced to flow into the branch channel other than the branch channel 5A. Therefore, even where the ink is unevenly distributed in an initial stage, the ink is eventually forced to be evenly distributed into both of the branch channels 5A, 5B, namely, substantially the same amount of the ink flows into the branch channels 5A, 5B, as shown in FIG. 2C. Thus, the ink is ejected evenly from an entirety of the nozzle plate 10 which is provided by the head unit 1, as indicated by arrows in FIG. 2C. This arrangement makes it possible to establish the even ejection of the ink from the entirety of the nozzle plate 10, in a smaller length of time than in an arrangement which depends on a spontaneous establishment of the even ejection that has to be awaited.

Figure 3:
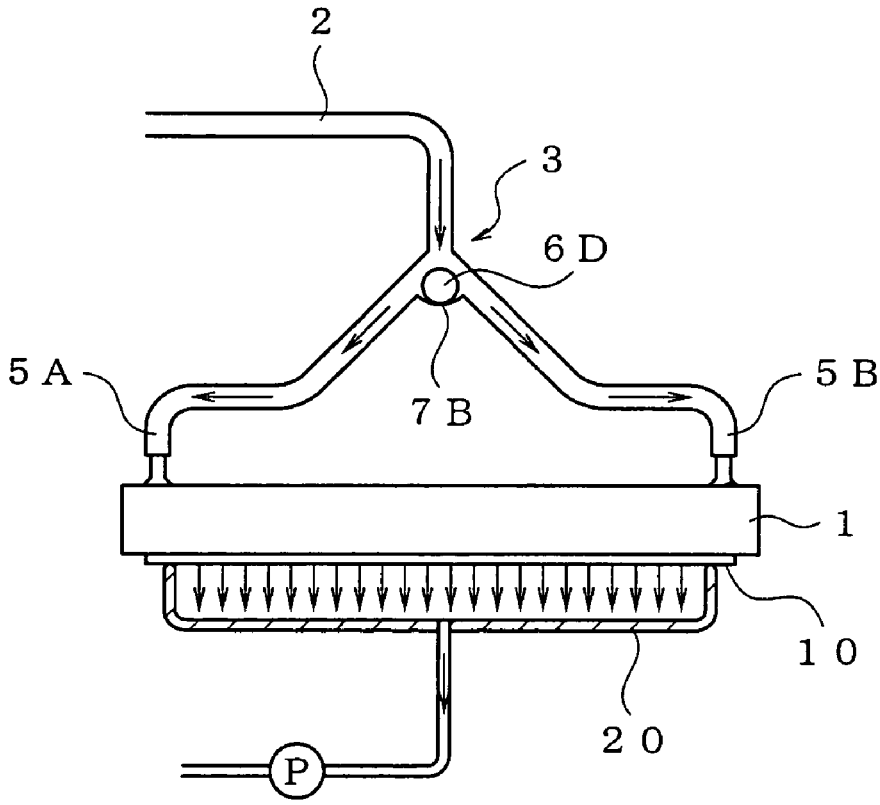
FIG. 3 is a view schematically illustrating an arrangement in which the ink storage chamber is not provided at the fork.

FIG. 3 shows another embodiment in which an ink storage chamber is not provided at the fork 3 at which the ink channel 2 is divided into the two branch channels 5A, 5B. In other words, the fork 3 is defined by a relatively small chamber which does not substantially serve as an ink storage chamber, although the relatively small chamber serves as an accommodation chamber for accommodating a rollable body 6D. In this embodiment, too, the rollable body 6D is freely movably disposed on a recess 7B formed in a bottom wall faces the fork 3, so as to increase the flow resistance in one of the branch channels 5A, 5B, into which the larger amount of the ink currently flows, so that the newly supplied ink is forced to flow into the other of the branch channels 5A, 5B. Therefore, even where the ink is unevenly distributed in an initial stage, the ink is eventually forced to be evenly distributed into both of the branch channels 5A, 5B, so that the ink is ejected evenly from an entirety of the nozzle plate 10, as shown in FIG. 3. Thus, it is possible to obtain a desired printing accuracy, in a small length of time measured from a point of time of initial introduction of the ink into the head unit 1 or replacement of the ink cartridge with a new one. In this embodiment, owing to the relatively small size of the chamber defining the fork 3, the rollable body 6D has a small size, enabling the inkjet printer head H to be made compact in size.

Figure 6:
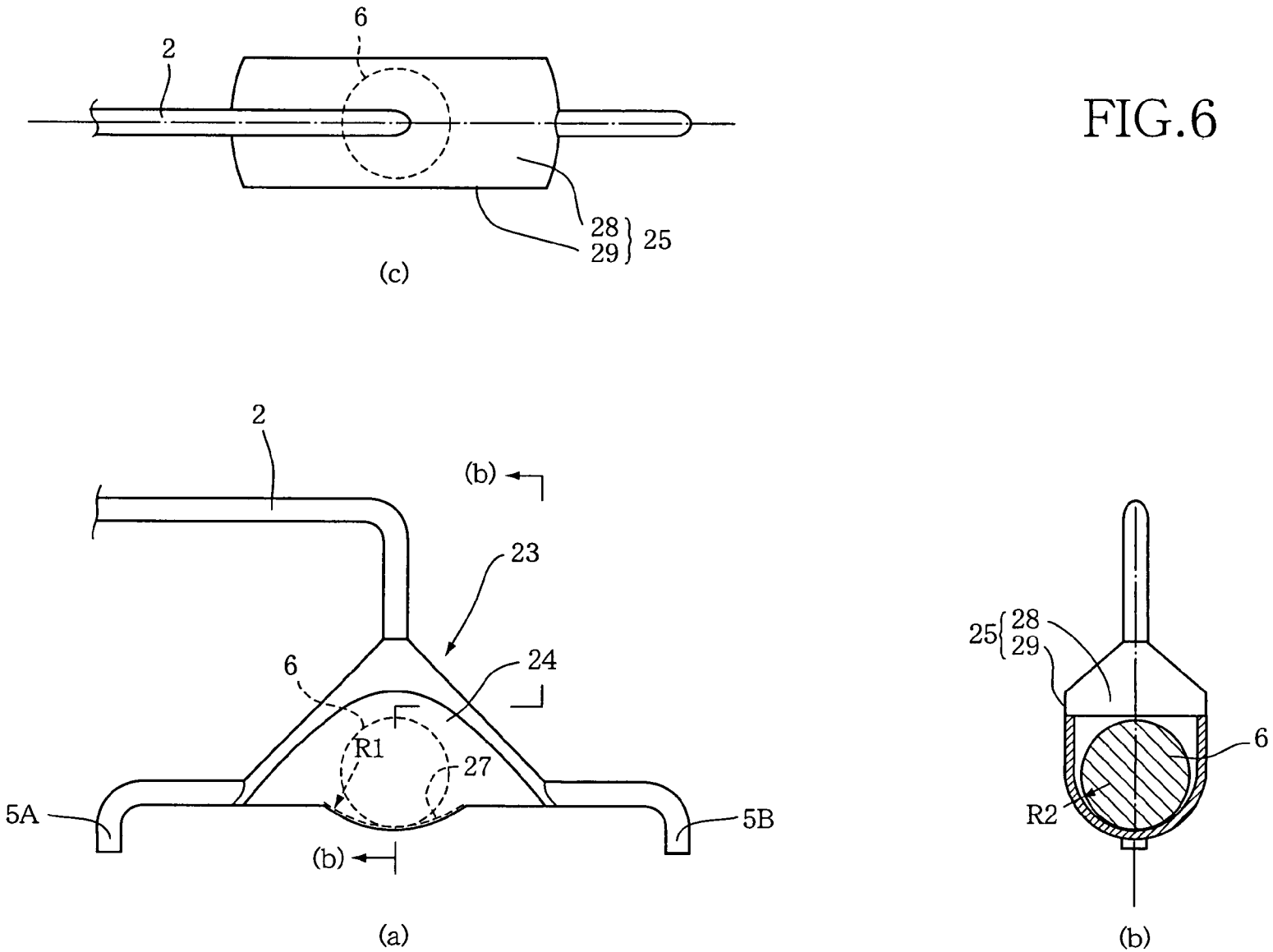
FIG. 6 is a set of views showing an arrangement in which an ink storage chamber is defined by a semi-conical-shaped circumferential wall, wherein (a) is a front view, (b) is a side view partially in cross section, and (c) is an upper plan view.

FIG. 6 is a set of views showing a still another embodiment in which an accommodation chamber or ink storage chamber 24 is defined by a semi-conical-shaped circumferential wall 25, wherein (a) is a front view, (b) is a side view partially in cross section, and (c) is an upper plan view. The partial cross section of the side view (b) is a section taken along line (b)-(b) of the view (a). In this embodiment, the ink storage chamber 24 (providing a fork 23 at which the single ink channel 2 is divided into the two branch channels 5A, 5B) has a shape which is obtained by removing, form a generally conical shape, two portions located outside respective two flat planes which are parallel to each other and are equally spaced apart from an axis of the conical shape. In other words, the ink storage chamber 24 is defined by the semi-conical-shaped circumferential wall 25 which includes two part-conical walls 28 and two mutually parallel flat walls 29 that are alternatively arranged in a circumferential direction of the chamber 24, such that the two mutually parallel flat walls 29 are spaced apart from an axis of the semi-conical-shaped circumferential wall 25 by substantially the same distance. The rollable body 6 provided by the spherical body is disposed between the two mutually parallel walls 29 which face the fork 23 and which are spaced apart from each other by a distance slightly larger than a diameter of the rollable body 6. The two branch channels 5A, 5B are held in communication with respective opposite end portions of a space defined between the two mutually parallel walls 29.

The two part-conical walls 28 are opposed to each other, and are inclined such that a distance between the walls 28 is reduced as viewed in a direction away from a bottom wall of the ink storage chamber 24. The ink channel 2 faces an upper end region of the ink storage chamber 24 in which the distance between the walls 28 is minimized, while the two branch channels 5A, 5B face respective opposite end portions of a lower end region of the chamber 24 in which the distance is maximized. The two part-conical walls 28 cooperate with each other to serve as a movement limiter for limiting the movement of the rollable body 6 such that the body 6 is movable within a limited area in which the body 6 is in contact with a curved surface of a recess 27 which is formed in a central portion of a bottom wall of the ink storage chamber 24.

The curved surface of the recess 27 is symmetrical with respect to a first plane containing the axis of the circumferential wall 25 and perpendicular to the bottom wall of the chamber 24, and also with respect to a second plane perpendicular to the bottom wall and perpendicularly intersecting the first plane at the axis of the circumferential wall 25. A radius R1 (see (a) of FIG. 6) of curvature of the curved surface of the recess 27 as measured on the first plane is larger than a radius R2 (see (b) of FIG. 6) of curvature of the curved surface of the recess 27 as measured on the second plane. The two branch channels 5A, 5B extend from respective regions of the chamber 24 which substantially lie on the first plane, or which are opposed to each other in a direction in which the first plane extends. The relatively large radius R1 of curvature (as measured on the first plane) causes the rollable body 6 to be movable easier in the direction in which the first plane extends (i.e., in the direction in which the two branch channels 5A, 5B are opposed to each other), than in a direction in which the second plane extends. The relatively small radius R2 of curvature (as measured on the second plane) is effective to restrain movement of the rollable body 6 in the direction in which the second plane extends. Further, the movement of the rollable body 6 in the direction of the second plane is limited by its contact with each of the two mutually parallel walls 29, the distance between which is larger than the diameter of the rollable body 6 by a minimum distance.

As is clear from the above-description, in the present embodiment, the rollable body 6 is arranged to be easily movable from the center of the recess 27 in two opposite directions toward the regions of the ink storage chamber 24 from which the respective two branch channels 5A, 5B extend, while being restricted from being moved in directions other than the two opposite directions. Further, the ink storage chamber 24 defined by the semi-conical-shaped circumferential wall 25 has a smaller width as measured in the direction of the above-described second plane, than the ink storage chamber 4 defined by the conical-shaped circumferential wall 4A, thereby making it possible to easily arrange a plurality of ink storage chambers 24 in a row within a limited space of the inkjet printer head H.

Figure 7:
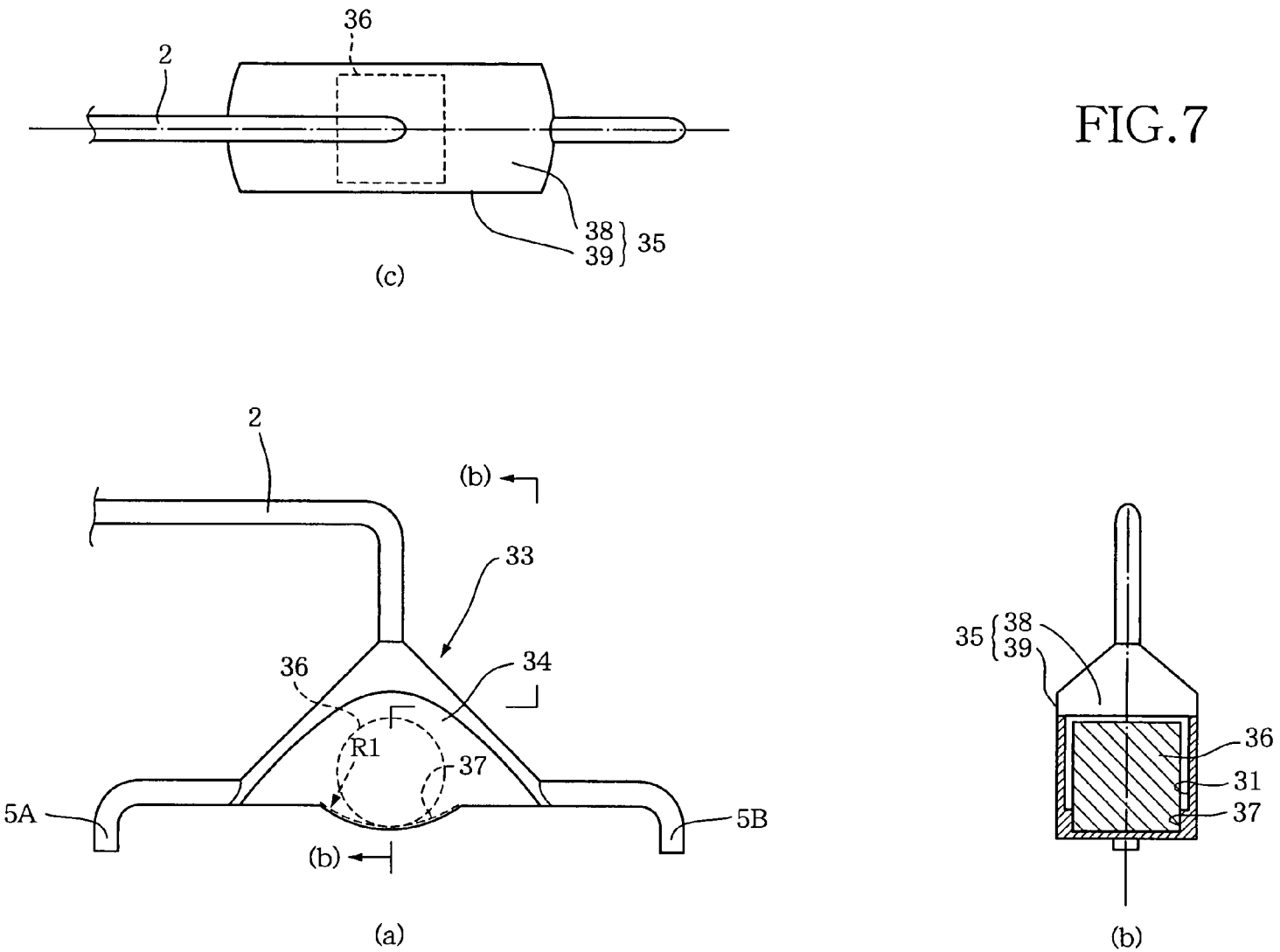
FIG. 7 is a set of views showing an arrangement in which a rollable body is provided by a cylindrical body, wherein (a) is a front view, (b) is a side view partially in cross section, and (c) is an upper plan view.

FIG. 7 is a set of views showing a further embodiment in which a rollable body 36 is provided by a cylindrical body rather than a spherical body, wherein (a) is a front view, (b) is a side view partially in cross section, and (c) is an upper plan view. In this embodiment, an ink storage chamber 34 (providing a fork 33 at which the single ink channel 2 is divided into the two branch channels 5A, 5B) is defined by a semi-conical-shaped circumferential wall 35 which includes two part-conical walls 38 and two mutually parallel flat walls 39 that are alternatively arranged in a circumferential direction of the chamber 34, such that the two mutually parallel flat walls 39 are spaced apart from an axis of the semi-conical-shaped circumferential wall 35 by substantially the same distance. The rollable body 36 provided by the cylindrical body is disposed between the two mutually parallel flat walls 39 which face the fork 33 and which are spaced apart from each other by a distance larger than an axial length of the rollable body 6. The two branch channels 5A, 5B are held in communication with respective opposite end portions of a space defined between the two mutually parallel flat walls 39.

The two part-conical walls 38 are opposed to each other, and are inclined such that a distance between the walls 38 is reduced as viewed in a direction away from a bottom wall of the ink storage chamber 34. The ink channel 2 faces an upper end region of the ink storage chamber 34 in which the distance between the walls 38 is minimized, while the two branch channels 5A, 5B face respective opposite end portions of a lower end region of the chamber 34 in which the distance is maximized. The two part-conical walls 38 cooperate with each other to serve as a movement limiter for limiting the movement of the rollable body 36 such that the body 36 is movable within a limited area in which the body 36 is in contact with a curved surface of a recess 37 which is formed in a central portion of a bottom wall of the ink storage chamber 34.

The curved surface of the recess 37 is provided by a part-cylindrical surface whose axis is substantially perpendicular to the two mutually parallel flat walls 39. A radius of curvature of the part-cylindrical surface of the recess 37 is larger than a radius of the rollable body 36 provided by the cylindrical body, which is disposed on the recess 37 such that an axis of the rollable body 36 is held in parallel with the axis of the part-cylindrical surface of the recess 37. The two branch channels 5A, 5B extend from respective regions of the chamber 24 which are opposed in a direction that is perpendicular to the axes of the rollable body 36 and the part-cylindrical surface of the recess 37. Thus, the rollable body 36 is arranged to be movable in the direction in which the two branch channels 5A, 5B are opposed to each other. The recess 37 has an axial length (as measured in parallel with the axis of the part-cylindrical surface of the recess 37) is larger than an axial length of the rollable body 36 by a minimum amount (see (b) of FIG. 7) such that movement of the rollable body 36 in its axial direction is restrained. The mutually parallel flat walls 39 of the ink storage chamber 34 have respective inner surfaces 31 spaced apart from each other by a distance which is larger than the axial length of the recess 37, so that the distance between the inner surfaces 31 of the respective flat walls 39 is larger than the axial length of the rollable body 36 by an amount larger than the above-described minimum amount. This arrangement is effective to reduce a frictional resistance against the movement of the rollable body 36 in the direction in which the two branch channels 5A, 5B are opposed to each other, while restraining the movement of the rollable body 36 in its axial direction.

As is clear from the above description, in the inkjet printer head constructed according to the present invention, the rollable body (6; 6D; 36) is provided to be movably disposed at the fork (3; 23; 33) at which the ink channel (2) is divided into the branch channels (5A, 5B), so that the resistances acting on the flows of the ink into the respective branch channels (5A, 5B) can be balanced with each other, owing to the rollable body (6; 6D; 36) movable based on the flow of the ink around the rollable body (6; 6D; 36), thereby making it possible to substantially equalize amounts of the flows of the ink into the respective branch channels (5A, 5B).

While the presently preferred embodiments of the present invention have been described above in detail, it is to be understood that the invention is not limited to the details of the illustrated embodiments, but may be otherwise embodied.

For example, the rollable body (6; 6D; 36) does not necessarily have to be provided by a spherical body or a cylindrical body, but may be provided by otherwise shaped body, as long as the rollable body (6; 6D; 36) is given a suitable shape, weight and size which cooperate to enable the rollable body (6; 6D; 36) to be movable based on change in static pressure caused by the ink flowing through the accommodation chamber, for thereby substantially equalizing the resistances acting on the flows of the ink into the respective branch channels (5A, 5B). However, where the rollable body is provided by the spherical body, since the rollable body can be arranged to be freely movable in all directions over 360° around the rollable body, the number of the branch channels (5) into which the ink channel (2) is divided at the fork (3; 23; 33) may be more than two, namely, the fork (3; 23; 33) may be modified, as needed, such that the ink channel (2) is divided into more than two branch channels.

Further, the radius of curvature of the curved surface of the recess (7; 7B; 27; 37) does not have to be constant, but may be changed gradually or in steps. For example, the curved surface of the recess (7; 7B; 27) may have a relatively large radius of curvature and a relatively small radius of curvature in its non-peripheral portion and its peripheral portion, respectively, so that the movement of the rollable body (6; 6D) in the non-peripheral portion of the curved surface of the recess (7; 7B; 27) is less restrained than the movement of the rollable body (6; 6D) in the peripheral portion of the curved surface of the recess (7; 7B; 27). Similarly, the curved surface of the recess (37) (provided by the part-cylindrical surface) in the embodiment of FIG. 7 may have a relatively large radius of curvature and a relatively small radius of curvature in its central portion and its opposite end portions, respectively, so that the movement of the rollable body (36) in the central portion of the curved surface of the recess (37) is less restrained than the movement of the rollable body (36) in the opposite end portions of the curved surface of the recess (37).

What is claimed is:

1. An inkjet printer head comprising:

a head unit having a plurality of ink inlets and operable to eject an ink which is supplied through said ink inlets from an ink source, for performing a recording operation:

an ink channel held in communication with the ink source;

a plurality of branch channels held in communication with said ink inlets; and a rollable body movably disposed at a fork at which said ink channel is divided into said branch channels;

wherein said rollable body is configured to be rolled toward one of said branch channels in which static pressure is lowered by the ink flowing around said rollable body.

2. The inkjet printer head according to claim 1, wherein said rollable body is disposed on a recess formed in a bottom wall which faces said fork, and wherein said recess has a curved surface whose radius of curvature is larger than a radius of curvature of a curved outer surface of said rollable body.

3. The inkjet printer head according to claim 2, further comprising a movement limiter capable of limiting movement of said rollable body such that said rollable body is movable within a limited area in which said rollable body is in contact with said curved surface of said recess of said bottom wall.

4. The inkjet printer head according to claim 2, wherein said fork is provided by an accommodation chamber in which said rollable body is accommodated, wherein said accommodation chamber is defined by said bottom wall and two mutually opposed side walls which are inclined such that a distance between said side walls is reduced as viewed in a direction away from said bottom wall, wherein said ink channel faces an upper end region of said accommodation chamber in which said distance is minimized, and wherein said plurality of branch channels include two branch channels which face respective opposite end portions of a lower end region of said accommodation chamber in which said distance is maximized.

5. The inkjet printer head according to claim 4, further comprising a movement limiter capable of limiting movement of said rollable body such that said rollable body is movable within a limited area, wherein said movement limiter is provided by said two mutually opposed side walls such that said movement of said rollable body is limited by contact of said rollable body with each of said two mutually opposed side walls.

6. The inkjet printer head according to claim 1, wherein said rollable body is a spherical body.

7. The inkjet printer head according to claim 6,
wherein said spherical body is disposed on a recess formed in a bottom wall which faces said fork, and
which said recess has a curved surface whose radius of curvature is larger than a radius of said spherical body.

8. The inkjet printer head according to claim 6,
wherein said fork is provided by an accommodation chamber in which said spherical body is accommodated,
wherein said accommodation chamber is defined by a semi-conical-shaped circumferential wall which includes two part-conical portions and two flat portions that are alternately arranged in a circumferential direction of said accommodation chamber, and
wherein said two flat portions of said semi-conical-shaped circumferential wall are parallel to each other and are equally spaced apart from an axis of said semi-conical-shaped circumferential wall.

9. The inkjet printer head according to claim 1,
wherein said rollable body is a cylindrical body,
wherein said cylindrical body is disposed on a recess formed in a bottom wall which faces said fork, and
wherein said recess has a curved surface whose radius of curvature is larger than a radius of said cylindrical body.

10. The inkjet printer head according to claim 1,
wherein said rollable body is disposed between two mutually parallel walls which face said fork and which are spaced apart from each other by a distance larger than an outer dimension of said rollable body.

11. The inkjet printer head according to claim 10,
wherein said plurality of branch channels include two branch channels which are held in communication with respective opposite end portions of a space defined between said two mutually parallel walls.

12. An inkjet printer head comprising:
a head unit having a plurality of ink inlets and operable to eject an ink which is supplied through said ink inlets from an ink source, for performing a recording operation;
an ink channel held in communication with the ink source;
a plurality of branch channels held in communication with said ink inlets; and
a rollable body movably disposed at a fork at which said ink channel is divided into said branch channels;
wherein said fork is provided by an accommodation chamber in which said rollable body is accommodated,
wherein said accommodation chamber is defined by an upper wall, a circumferential wall and a bottom wall,
wherein said bottom wall has, in a central portion thereof, a recess which is convexed downwardly and which has a curved surface whose radius of curvature is larger than a radius of curvature of a curved outer surface of said rollable body,
wherein said ink channel is connected to said accommodation chamber through an opening which is formed through said upper wall, while said branch channels are connected to said accommodation chamber through respective openings each of which is formed through at least one of a peripheral portion of said bottom wall and a lower portion of said circumferential wall, and
wherein said rollable body is disposed on said recess such that said curved outer surface of said rollable body and an inner surface of said circumferential wall cooperate with each other to define therebetween a restrictor passage which restricts flow of the ink from said ink channel toward each of said branch channels.

13. An inkjet printer head comprising:
a head unit having a plurality of ink inlets and operable to eject an ink which is supplied through said ink inlets from an ink source, for performing a recording operation;
an ink storage chamber in which the ink is to be temporarily stored;
a rollable body rollably disposed on a recess formed in a bottom wall which defines said ink storage chamber;
an ink channel connected to said ink storage chamber through an opening formed through an upper wall which is opposed to said bottom wall and said rollable body, such that the ink can be supplied to said ink storage chamber from the ink source through said ink channel; and
a plurality of branch channels extending from respective regions of said ink storage chamber which are adjacent to said bottom wall, to said ink inlets of said head unit.

14. The inkjet printer head according to claim 13,
wherein said rollable body has a weight that enables said rollable body to be rolled on said recess, owing to a difference between said branch channels with respect to static pressure therein, which difference is caused by the ink flowing around said rollable body, and
wherein said rollable body has a size that increases a resistance against flow of the ink through one of said branch channels toward which said rollable body is rolled owing to said difference.

15. The inkjet printer head according to claim 14,
wherein said weight and size of said rollable body and a radius of curvature of said recess are respective values which cooperate to substantially equalize amounts of flows of the ink through the respective branch channels.

16. An inkjet printer head comprising:
a head unit having a plurality of ink inlets and operable to eject an ink which is supplied through said ink inlets from an ink source, for performing a recording operation;
an ink channel held in communication with the ink source;
a plurality of branch channels held in communication with said ink inlets; and
a rollable body movably disposed at a fork at which said ink channel is divided into said branch channels;
wherein said fork is provided by an accommodation chamber in which said rollable body is accommodated,
wherein said rollable body is a spherical body which is disposed on a recess formed in a bottom wall which defines said accommodation chamber,
wherein said recess has a curved surface which is symmetrical with respect to a first plane and is symmetrical with respect to a second plane that perpendicularly intersects with said first plane, such that a radius of curvature of said curved surface as measured on said first plane is larger than that as measured on said second plane, and
wherein said plurality of branch channels are two branch channels extending from respective regions of said accommodation chamber opposed to each other in a direction in which said first plane extends.

* * * * *